US011834877B2

(12) United States Patent
Manara et al.

(10) Patent No.: US 11,834,877 B2
(45) **Date of Patent: *Dec. 5, 2023**

(54) HINGE ASSEMBLY FOR A HOME APPLIANCE AND METHOD OF ASSEMBLING

(71) Applicant: WHIRLPOOL CORPORATION, Benton Harbor, MI (US)

(72) Inventors: Paulo Henrique Alves Manara, Joinville (BR); Ledimara Mascarello, Joinville (BR); Vinicius Simm, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 70 days.

This patent is subject to a terminal disclaimer.

(21) Appl. No.: 17/372,040

(22) Filed: Jul. 9, 2021

(65) Prior Publication Data

US 2021/0332625 A1 Oct. 28, 2021

Related U.S. Application Data

(63) Continuation of application No. 16/456,496, filed on Jun. 28, 2019, now Pat. No. 11,060,333.

(51) Int. Cl.
*E05D 11/10* (2006.01)
*F24B 13/00* (2006.01)

(52) U.S. Cl.
CPC ..... *E05D 11/105* (2013.01); *E05Y 2900/308* (2013.01); *F24B 13/004* (2013.01)

(58) Field of Classification Search
CPC ..... E05D 11/105; E05D 11/1078; E05D 11/1014; F24B 13/004
See application file for complete search history.

(56) References Cited

U.S. PATENT DOCUMENTS 54,618 A * 5/1866 Slusser ..... E05D 11/1078 16/351
263,950 A * 9/1882 Peckham ..... E05D 11/1007 16/353

(Continued)

FOREIGN PATENT DOCUMENTS

FR 2575512 B3 7/1987
FR 2934671 B1 9/2010

(Continued)

*Primary Examiner* — Jeffrey O'Brien
(74) *Attorney, Agent, or Firm* — Price Heneveld LLP

(57) ABSTRACT

A hinge assembly to couple a door with a cabinet, for movement between open and closed positions about a vertical axis, includes a first hinge plate coupled with the cabinet and a second hinge plate coupled with the door. The second hinge plate is moveable relative to the first hinge plate about a pivot pin that extends between the first and second hinge plates. One of the first and second hinge plates includes a step with a first surface vertically offset from a body of one of the first and second hinge plates and the other of the first and second hinge plates includes a second surface that engages the first surface when the door is in the closed position. When the door is moved into the open position, the second hinge plate travels downward relative to the first hinge plate such that the first surface becomes disengaged from the second surface.

18 Claims, 7 Drawing Sheets

(56) References Cited

U.S. PATENT DOCUMENTS 606,415 A * 6/1898 Hotaling ..... E05D 11/00 16/351
753,443 A * 3/1904 Hilaire ..... E05D 3/12 16/350
1,294,044 A * 2/1919 Buckwalter et al. ..... E05D 11/1007 16/351
3,510,986 A * 5/1970 Berkowitz ..... E05D 7/081 16/256
4,697,306 A * 10/1987 Rhodes ..... E05F 1/063 256/26
5,901,415 A * 5/1999 Morrison ..... E05D 3/12 16/334
5,915,441 A * 6/1999 Schlack ..... E05D 3/12 16/334
6,561,180 B1 5/2003 Austin et al.
6,813,813 B2 * 11/2004 Lu ..... G06F 1/1616 16/334
7,082,643 B2 * 8/2006 Lu ..... E05C 17/64 16/337
7,111,363 B2 * 9/2006 Lee ..... E05D 7/081 16/334
7,155,781 B2 * 1/2007 Yamada ..... G06F 1/162 16/374
7,520,027 B2 * 4/2009 Lu ..... G06F 1/1681 16/337
7,530,541 B2 * 5/2009 Wang ..... F16M 11/10 248/921
7,603,747 B2 * 10/2009 Ho ..... G06F 1/1681 16/340
7,669,286 B2 * 3/2010 Lu ..... G06F 1/1616 16/337
8,510,913 B2 * 8/2013 Kim ..... E05D 11/1028 16/334
9,115,903 B2 8/2015 Lim et al.
9,222,293 B2 * 12/2015 Jenkinson ..... E05D 7/0027
10,584,524 B2 * 3/2020 Fang ..... E05D 11/1014
10,648,213 B2 * 5/2020 Wright ..... E05D 11/1007
2007/0174997 A1 * 8/2007 Lu ..... B60R 11/0235 16/367
2010/0127514 A1 * 5/2010 Nilsson ..... E05D 11/105 292/285

FOREIGN PATENT DOCUMENTS

GB 2410059 B 7/2005
KR 20000034540 A 6/2000
KR 101314161 B1 10/2013

* cited by examiner

HINGE ASSEMBLY FOR A HOME APPLIANCE AND METHOD OF ASSEMBLING

CROSS-REFERENCE TO RELATED APPLICATION

This application a continuation of U.S. patent application Ser. No. 16/456,496, filed on Jun. 28, 2021, now U.S. Pat. No. 11,060,333, entitled "HINGE ASSEMBLY FOR A HOME APPLIANCE AND METHOD OF ASSEMBLING," the disclosure of which is hereby incorporated herein by reference in its entirety.

BACKGROUND OF THE DISCLOSURE

The present disclosure generally relates to a hinge assembly for a home appliance, and more specifically, to a hinge assembly for a cooking oven.

SUMMARY OF THE DISCLOSURE

According to an aspect of the present disclosure, hinge assembly for coupling a door with a cabinet, for movement between open and closed positions about a vertical axis, includes a first hinge plate coupled with the cabinet and a second hinge plate coupled with the door. The second hinge plate is moveable relative to the first hinge plate about a pivot pin that extends between the first and second hinge plates. One of the first hinge plate and the second hinge plate includes a step that has a first surface vertically offset from a body of one of the first hinge plate and the second hinge plate and the other of the first hinge plate and the second hinge plate includes a second surface that engages the first surface when the door is in the closed position. The hinge assembly is configured such that when the door is moved into the open position, the second hinge plate travels downward relative to the first hinge plate such that the first surface becomes disengaged from the second surface.

According to another aspect of the present disclosure, a hinge assembly includes a first hinge plate and a second hinge plate that is moveable relative to the first hinge plate about a pivot pin. One of the first hinge plate and the second hinge plate includes a step that has a first surface vertically offset from a body of one of the first hinge plate and the second hinge plate and the other of the first and second hinge plate includes a second surface that engages the first surface when said hinge assembly is in a closed position. The second hinge plate travels downward relative to the first hinge plate during opening such that the first surface becomes disengaged from the second surface. The step is configured to inhibit movement to the closed position until a vertical force is applied to lift the second hinge plate relative to the first hinge plate to bring the first and second surfaces into engagement.

These and other features, advantages, and objects of the present disclosure will be further understood and appreciated by those skilled in the art by reference to the following specification, claims, and appended drawings.

Figure 1:
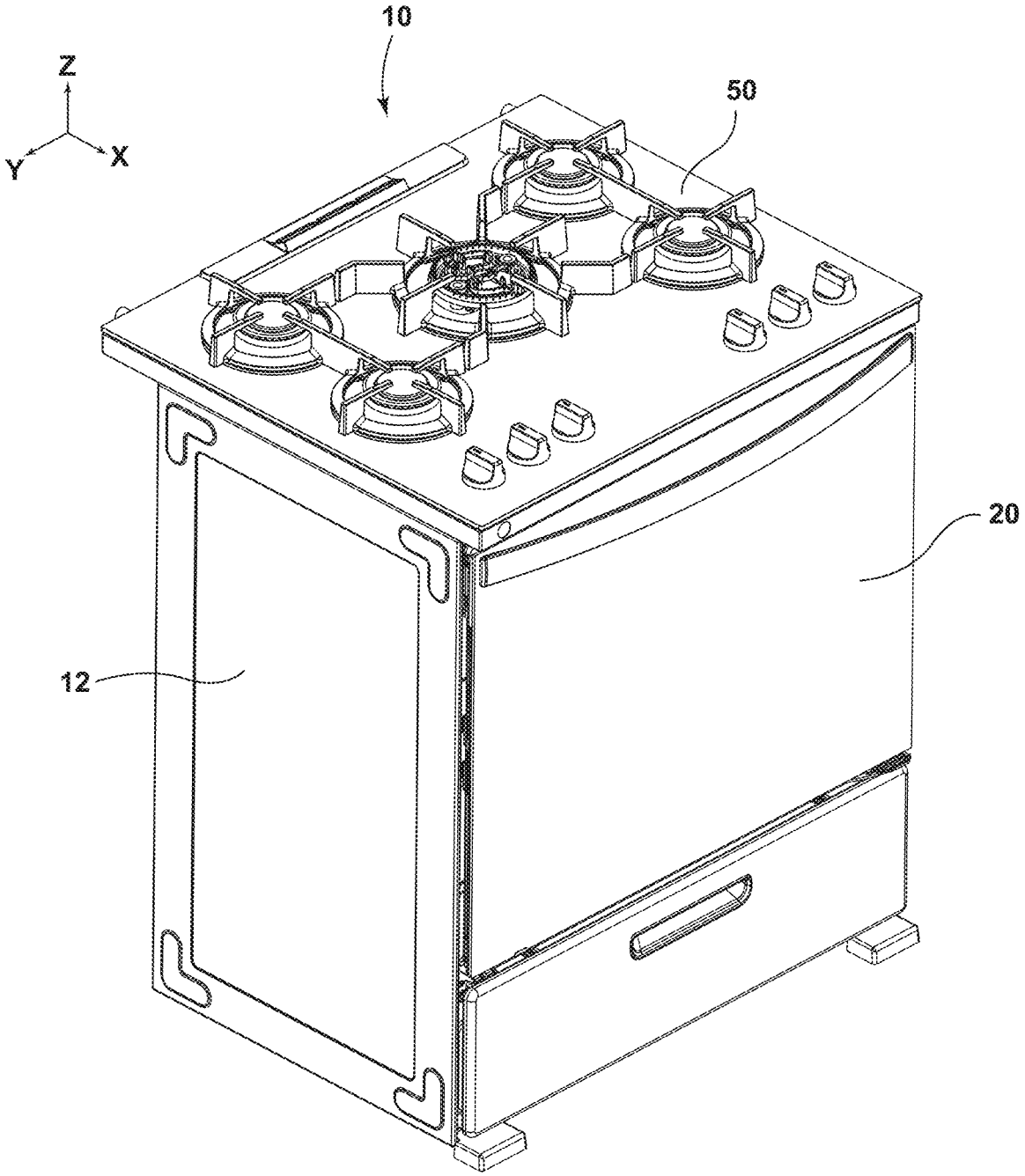
FIG. 1 is a perspective view of a home appliance in the form of a cooking oven having a door in a closed position, according to an aspect of the present disclosure.
Figure 2:
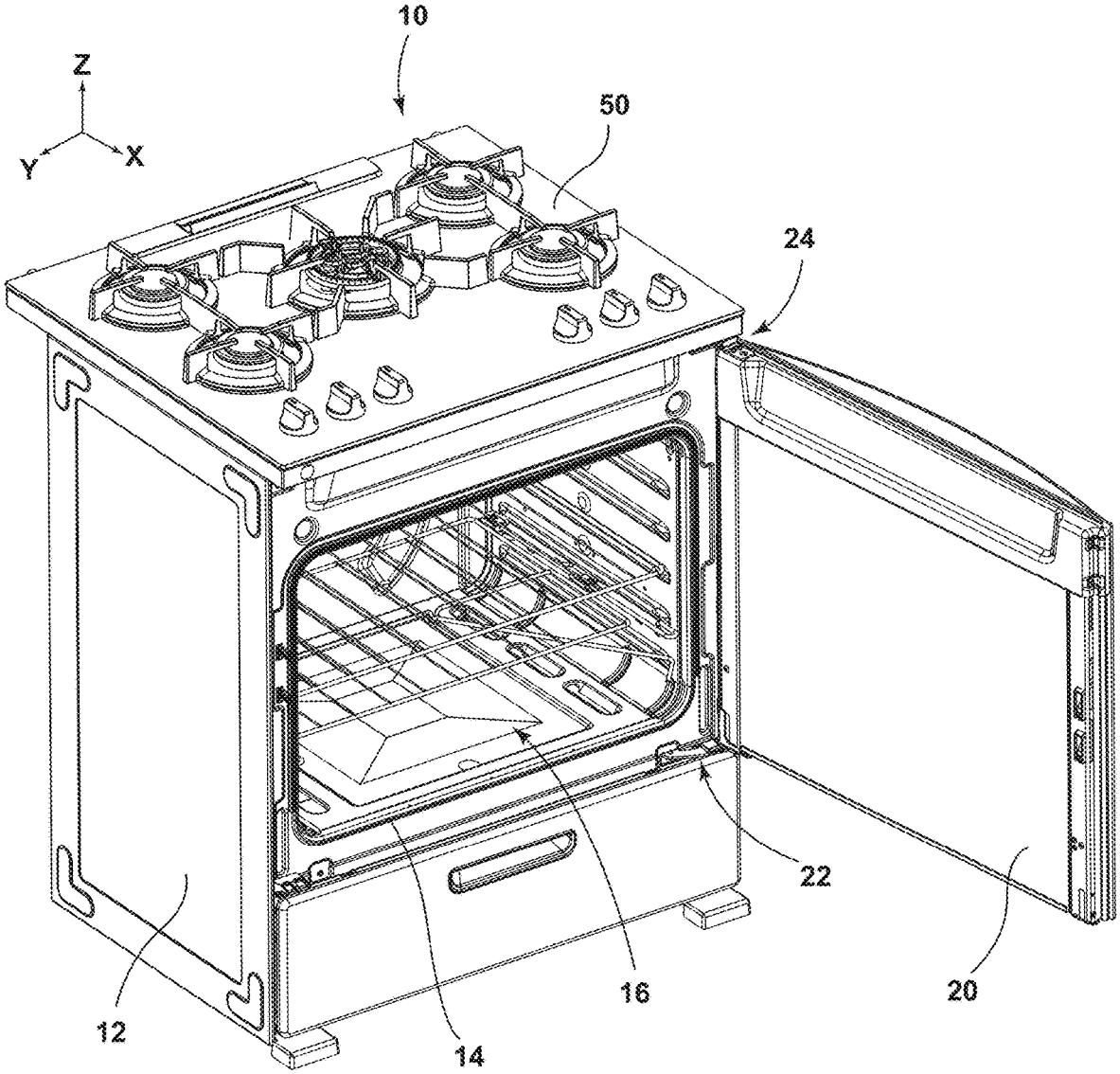
FIG. 2 is a perspective view of the home appliance of FIG. 1 showing the door in an open position, according to an aspect of the present disclosure.

The components in the figures are not necessarily to scale, emphasis instead being placed upon illustrating the principles described herein.

DETAILED DESCRIPTION

The present illustrated embodiments reside primarily in combinations of apparatus components and method steps and relating to a hinge assembly for a door of a home appliance, such as a cooking oven, that is moveable between open and closed positions about a vertical axis. Aspects of the present disclosure relate to a hinge assembly that inhibits the appliance door from inadvertently closing on a user of the home appliance after the door has been moved into an open position. A hinge assembly according to an aspect of the present disclosure can be configured to inhibit the door from inadvertently closing on a user of the home appliance by requiring the user to impart a vertical force in addition to the rotational force required to close the door. In some aspects, the hinge assembly of the present disclosure is configured such that the user is not required to impart a vertical force in order to open the door, but a vertical force is required to be imparted by the user in order to move the door back into the closed position, thereby inhibiting the door from inadvertently closing on the user. In some aspects of the present disclosure, the hinge assembly also includes a stop that limits the extent to which the door can be opened by limiting the maximum angle of rotation that the hinge assembly can be rotated.

Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. The term "vertical" as used herein encompasses axes and planes that generally extend at a right angle with respect to a horizontal surface upon which the home appliance of FIG. 1 rests, unless otherwise noted. It is understood that a vertical axis or plane may vary from a right angle due to natural variations in the environment in which the home appliance is situated, installation conditions, user preferences, component tolerances, and the like. The term "horizontal" as used herein encompasses axes and planes that generally extend parallel to a horizontal plane defined by the horizontal surface upon which the home appliance of FIG. 1 rests, unless otherwise specifically noted. It is understood that a horizontal axis or plane may vary due to natural variations in the environment in which the home appliance is situated, installation conditions, user preferences, component tolerances, and the like. As used herein, a door of a home appliance is considered to open and close about a vertical axis when the door is pivoted to the left or the right of a user of the home appliance during opening of the door, even if the vertical axis that the door is pivoted about is not orthogonal to the surface upon which the home appliance rests. As used herein, a door of a home appliance is considered to open and close about a horizontal axis when the door is pivoted upward or downward by the user and remains generally in front of the user during opening and closing of the door.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Figure 3:
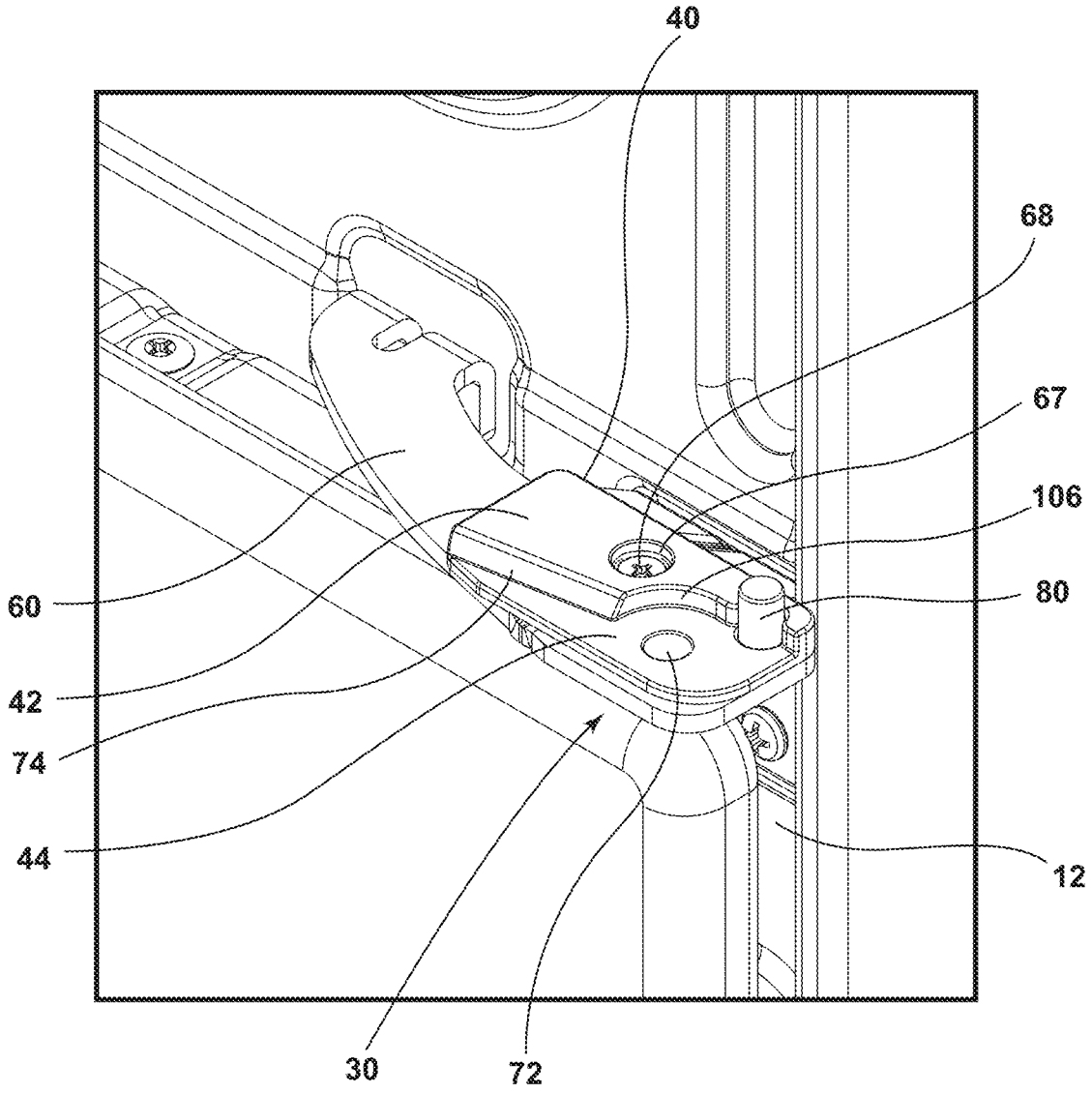
FIG. 3 is a perspective view of a portion of a hinge assembly shown with the home appliance of FIG. 1, according to an aspect of the present disclosure.
Figure 4:
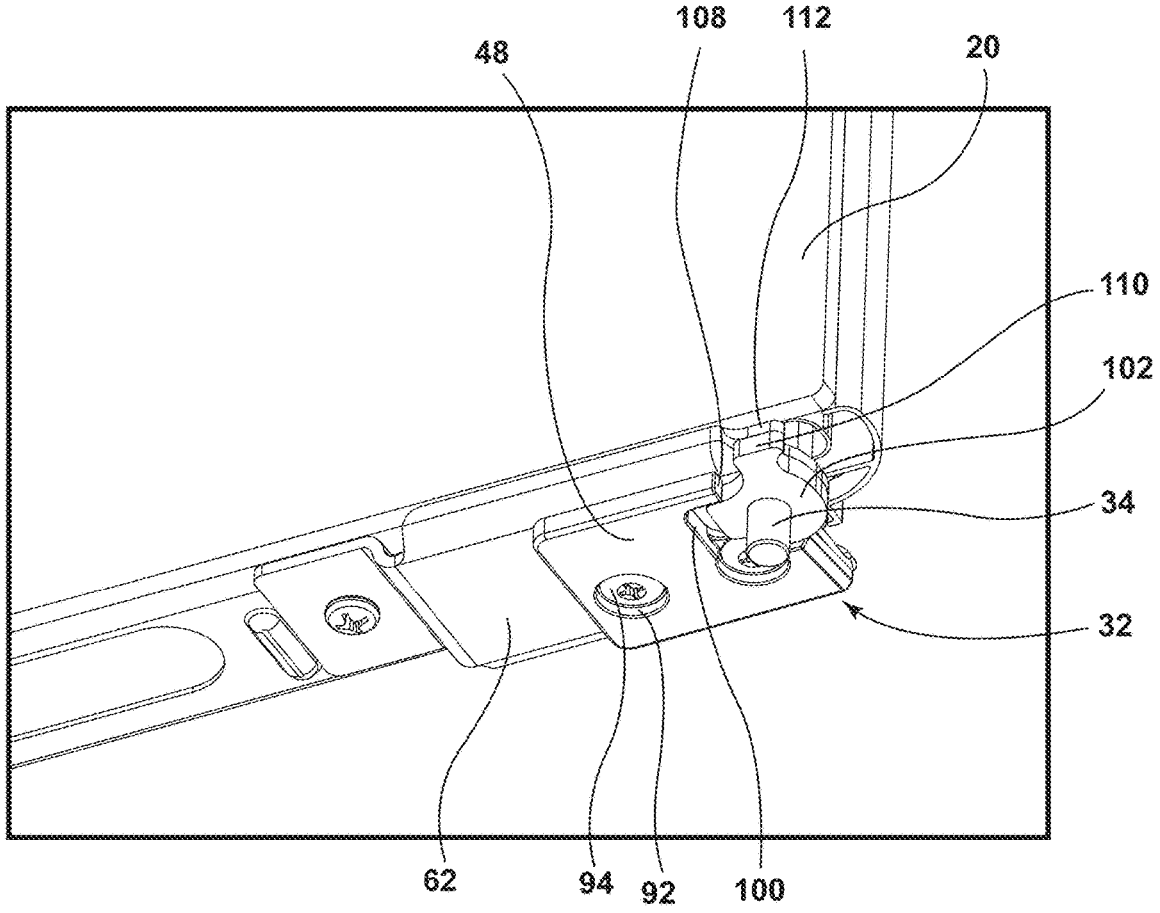
FIG. 4 is a perspective view of a portion of a hinge assembly shown with the home appliance of FIG. 1, according to an aspect of the present disclosure.
Figure 5:
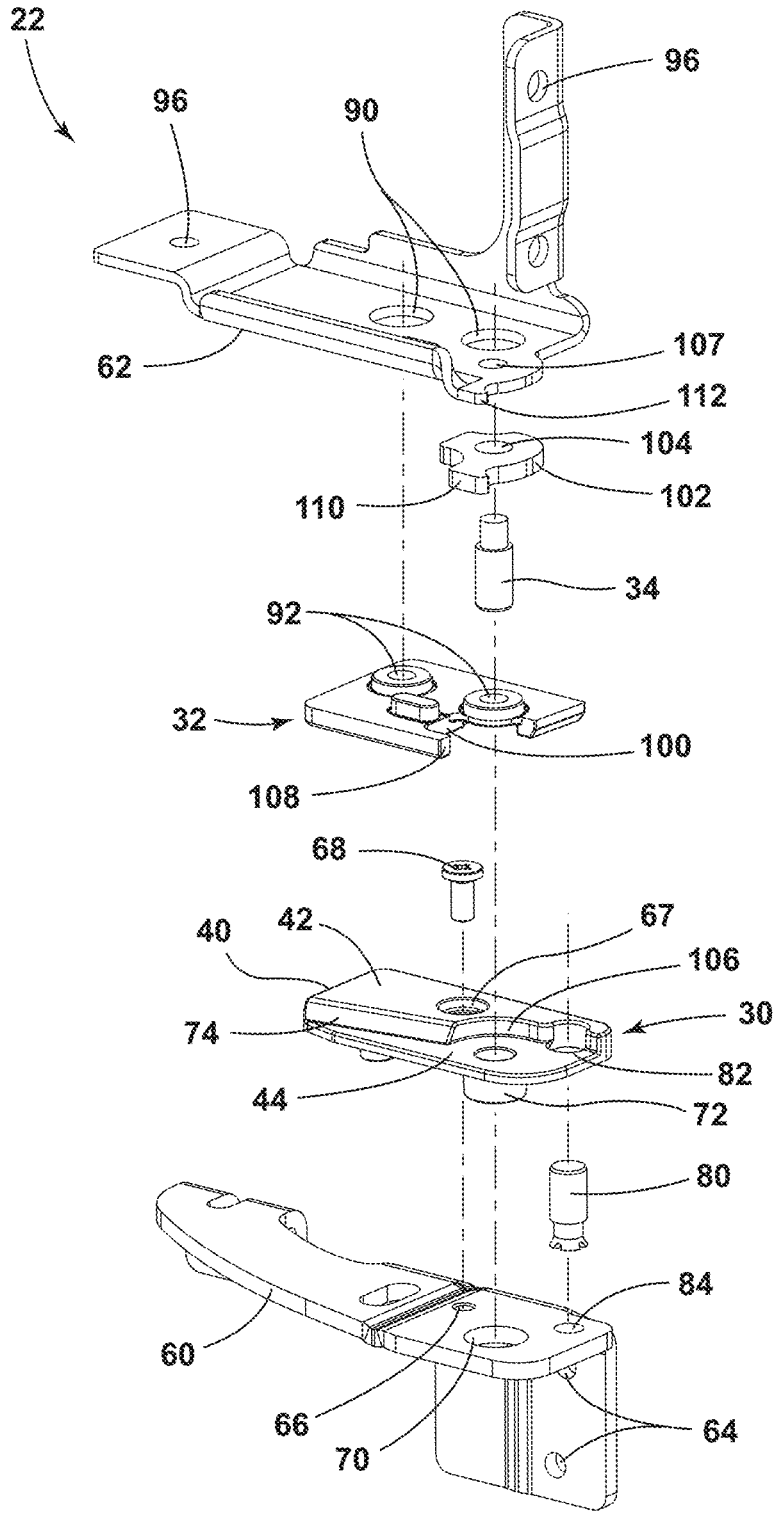
FIG. 5 is a partially exploded view of the hinge assembly of FIGS. 3 and 4, according to an aspect of the present disclosure.

Referring to FIGS. 1-8, reference numeral 10 generally designates a home appliance in the form of a cooking oven. The home appliance 10 includes a cabinet 12 defining an interior and having an access opening 14 to a chamber 16 disposed within the interior. A door 20 is coupled with the cabinet 12 to selectively provide access to the chamber 16 and is moveable about a vertical axis between a closed position, illustrated in FIG. 1, and an open position, illustrated in FIG. 2. The home appliance 10 includes a first hinge assembly 22 for moveably coupling a bottom portion of the door 20 with the cabinet 12 and a second hinge assembly 24 for moveably coupling an upper portion of the door 20 with the cabinet 12 for movement of the door 20 about the vertical axis between the open and closed positions. With reference to FIGS. 3-5, the first hinge assembly 22 includes a first hinge plate 30 coupled with the cabinet 12 and a second hinge plate 32 coupled with the door 20 that is moveable relative to the first hinge plate 30 about a pivot pin 34 that extends between the first and second hinge plates 30, 32. As illustrated in FIGS. 3-5, the first hinge plate 30 includes a step 40 having a first surface 42 vertically offset from a body 44 of the first hinge plate 30. The second hinge plate 32 includes a second surface 48 that engages the first surface 42 when the door 20 is in the closed position. The first hinge assembly 22 is configured such that when the door 20 is moved into the open position of FIG. 2, the second hinge plate 32 travels downward relative to the first hinge plate 30 and such that the first and second surfaces 42 and 48 become disengaged. The step 40 is configured to inhibit movement of the door 20 back into the closed position until a vertical force is applied to lift the door 20, and thus also lift the second hinge plate 32, relative to the first hinge plate 30 to bring the first and second surfaces 42 and 48 back into engagement.

While aspects of the present disclosure are discussed in the context of the first hinge plate 30 being coupled with the cabinet 12 and the second hinge plate 32 being coupled with the door 20, optionally, the position of the first and second hinge plates 30 and 32 can be reversed (not shown). The first hinge plate 30 can be coupled with the door 20 and the second hinge plate 32 can be coupled with the cabinet 12 such that when the door 20 is moved into the open position, the step 40 is moved off the second hinge plate 32 and the first and second surfaces 42 and 48 become disengaged. In addition, while aspects of the present disclosure are discussed in the context of a door 20 that pivots to the right of the home appliance 10 during opening of the door 20, it is understood that the aspects of the present disclosure can be used in a similar manner in the context of a door 20 configured to pivot to the left of the home appliance 10 during opening of the door 20.

While aspects of the present are discussed in the context of a cooking oven, it is within the scope of the present disclosure for aspects of the present disclosure to be utilized in a variety of home appliances, non-limiting examples of which include a microwave oven, a refrigerator, a freezer, and a laundry treating appliance, such as a clothes dryer or clothes washer, for example. When the home appliance 10 is in the form of a cooking oven, the cabinet 12 may be a housing including a chassis and/or frame which defines the interior and which encloses components typically found in a conventional cooking oven, such as electrical components, heating elements, gas lines, valves, control units, burner elements, broiler elements, and the like. Such components will not be described further herein except where necessary for a complete understanding of the aspects of the present disclosure. When the home appliance 10 is in the form of a cooking oven, the cooking oven 10 can include a cooktop 50 including one or more burner elements and actuators, the specific design of which is not germane to the aspects of the present disclosure and which may vary depending on the type of home appliance. The cooktop 50 can be a gas powered cooktop whereby the burner elements are configured to provide a heat source by burning a gas fuel source or an electric powered cooktop whereby the burner elements include resistive heating elements that are powered by a flow of electricity thereto. In the context of a cooking oven 10, the chamber 16 can be a cooking chamber and gas and/or electric heating elements (not shown) can be provided within the cabinet 12 for providing heat to the cooking chamber 16 during a cooking cycle.

With reference to FIGS. 3-5, the first hinge plate 30 can be coupled with the cabinet 12 by a first mounting bracket 60 and the second hinge plate 32 can be coupled with the door 20 by a second mounting bracket 62. While the first and second hinge plates 30 and 32 are described in the context of being coupled with the cabinet 12 and the door 20, respectively, it is understood that the first hinge plate 30 can alternatively be coupled with the door 20 using the first mounting bracket 60 or another mounting bracket and the second hinge plate 32 can alternatively be coupled with the cabinet 12 by the second mounting bracket 62 or another mounting bracket. The shape and dimensions of the first and second mounting brackets 60 and 62 may vary based on the design of the home appliance and can be coupled with the components of the home appliance using any suitable mechanical and/or non-mechanical fasteners, non-limiting examples of which include screws, bolts, snap-fit connectors, interference fit connectors, welds, adhesives, and the like.

In the embodiments illustrated in FIGS. 3 and 5, the first mounting bracket 60 includes a plurality of apertures 64 for coupling the first mounting bracket 60 with the cabinet 12 using a plurality of mechanical fasteners. The first mounting bracket 60 can include an aperture 66 configured to receive a mechanical fastener 68 which is inserted through an aperture 67 in the first hinge plate 30 for coupling the first hinge plate 30 with the first mounting bracket 60. The first mounting bracket 60 can include an aperture 70 configured to receive a sleeve 72 of the first hinge plate 30 that is configured to receive and support the pivot pin 34 therein.

With reference to FIG. 5, first surface 42 of the step 40 can be coupled with the body 44 of the first hinge plate 30 by a wall 74. The wall 74 can extend between the first surface 42 and the body 44 at an angle of about 90 degrees or less relative to a horizontal plane extending through the body 44. In some aspects, the wall 74 can extend at an angle of about 90 degrees or less, about 80 degrees or less, about 70 degrees or less, about 60 degrees or less, or about 50 degrees or less, relative to a horizontal plane extending through the body 44. In some aspects the wall 74 can extend at an angle of about 40 degrees to about 90 degrees, about 50 degrees to about 90 degrees, about 60 degrees to about 90 degrees, about 70 degrees to about 90 degrees, 40 degrees to about 80 degrees, about 50 degrees to about 80 degrees, about 60 degrees to about 80 degrees, about 70 degrees to about 80 degrees, 40 degrees to about 70 degrees, about 50 degrees to about 70 degrees, or about 60 degrees to about 70 degrees, relative to a horizontal plane extending through the body 44. In some aspects, the wall 74 can extend at an angle of about 57 degrees, relative to a horizontal plane extending through the body 44. Preferably, the wall 74 extends between the body 44 to the first surface 42 at an angle less than about 90 degrees in order to provide a sloped or ramped surface over which the second hinge plate 32 may travel as the second hinge plate 32 travels down and up the step 40 as the door 20 is opened and closed.

The dimensions of the step 40 and the wall 74 can vary based on a variety of characteristics of the home appliance, such as the type of home appliance, the dimensions of the door 20, and/or a weight of the door 20, for example. In some aspects the dimensions and angle of the wall 74 can vary based on a desired amount of force to be required to move the second hinge plate 32 over the step 40 to close the door and bring the first and second surfaces 42 and 48 back into engagement. As the angle between the wall 74 and the body 44 approaches 90 degrees, the vertical force required to lift the second hinge plate 32 up the step 40 will increase. Increasing the vertical offset of the step 40 can also increase the vertical force required to lift the second hinge plate 32 up the step 40. In addition, if the vertical offset of the step 40 is too high, a user may feel an undesirable drop sensation as the door 20 is moved into the open position. In the exemplary embodiment of the cooking oven 10 of FIGS. 1-2, the first surface 42 of the step 40 can be vertically offset from the body 44 by from about 2.5 mm to about 3.5 mm. In one example, the wall 74 can extend between the first surface 42 and the body 44 at an angle of about 50 degrees to about 70 degrees, such as about 57 degrees.

The step 40 and the body 44 can be integrally formed or can be formed from separate parts and secured using one or more mechanical and/or non-mechanical fasteners. Optionally, one or more portions of the first hinge plate 30 can be integrally formed with one or more portions of the first mounting bracket 60. In one aspect, the first hinge plate 30 can be made from a polymeric material and the first mounting bracket 60 can be made from a metal or metal alloy and mechanical and/or non-mechanical fasteners can be used to secure the first hinge plate 30 with the first mounting bracket 60.

A first stop 80 can be associated with the first hinge plate 30 for limiting an angle of rotation of the second hinge plate 32 relative to the first hinge plate 30. The first stop 80 can be provided as a separate component coupled with the first hinge plate 30 and/or the first mounting bracket 60 or may be integrally formed with either the first hinge plate 30 or the first mounting bracket 60. As illustrated in FIGS. 3 and 5, the first hinge plate 30 includes a stop aperture 82 and the first mounting bracket 60 includes a stop aperture 84 through which the first stop 80 is inserted for mounting relative to the first hinge plate 30. The first stop 80 can be supported within the stop apertures 82 and 84 by any suitable mechanical and/or non-mechanical fastener, examples of which include an interference fit, a snap fit, an adhesive, or a weld. While the first stop 80 is illustrated as a pin, it is understood that the first stop 80 can be a projection or raised component having any desirable shape.

Referring now to FIGS. 4-5, the second mounting bracket 62 can include one or more apertures 90 configured to align with apertures 92 in the second hinge plate 32 to couple the second hinge plate 32 and the second mounting bracket 62 together using mechanical fasteners 94. The second mounting bracket 62 can also include one or more additional apertures 96 for coupling the second mounting bracket 62 with the door 20. The second hinge plate 32 and the second mounting bracket 62 can be formed separately and secured together using mechanical and/or non-mechanical fasteners (as shown). Optionally, one or more portions of the second hinge plate 32 can be integrally formed with the second mounting bracket 62. In one aspect, the second hinge plate 32 can be made from a polymeric material and the second mounting bracket 62 can be made from a metal or metal alloy and mechanical and/or non-mechanical fasteners can be used to secure the second hinge plate 32 with the second mounting bracket 62.

The second hinge plate 32 can include a recess 100 that is configured to receive a third hinge plate 102. The third hinge plate 102 includes an aperture 104 which is configured to receive the pivot pin 34 when the third hinge plate 102 is mounted on the first hinge plate 30. The first hinge plate 30 can include a socket 106 formed in the step 40 that is configured to receive the third hinge plate 102 and allow the third hinge plate 102 to move about the pivot pin 34 relative to the first hinge plate 30. The pivot pin 34 extends from the sleeve 72 in the first hinge plate 30, through the aperture 104 in the third hinge plate 102, and into an aperture 107 in the second bracket 62 to define the vertical axis about which the door 20 rotates, and thus the second hinge plate 32 and the second mounting bracket 62 also rotate, as the door 20 is moved between the open and closed positions.

The second hinge plate 32 can include a leg 108 that engages a projection 110 of the third hinge plate 102 when the second hinge plate 32 is moved about the pivot pin 34 during the opening and closing of the door 20. The second hinge plate 32 and the third hinge plate 102 are configured such that the leg 108 engages the projection 110 and causes the third hinge plate 102 to rotate about the pivot pin 34 when the door 20 is opened. The projection 110 can optionally be configured to engage the first stop 80 to limit the extent to which the third hinge plate 102, and thus also the second hinge plate 32, is rotated as the door 20 is opened.

While the hinge assembly 22 is described in the context of having a third hinge plate 102, it is within the scope of the present disclosure that the hinge assembly 22 does not include the third hinge plate 102 or that at least a portion of the third hinge plate 102 be incorporated into the second hinge plate 32. In one example, the third hinge plate 102 may be absent and optionally the second hinge plate 32 includes the projection 110 that is configured to engage the first stop 80 to limit the angle of rotation of the second hinge plate 32 relative to the first hinge plate 30.

The second mounting bracket 62 can optionally include a second stop 112 that is configured to engage the first stop 80 as the door 20 is opened to limit an angle of rotation of the second hinge plate 32 relative to the first hinge plate 30, and thus limit the extent to which the door 20 can be opened. The second stop 112 can be integrally formed with the second mounting bracket 62 or may be a separate component coupled with the second mounting bracket 62. In another example, the second stop 112 may be integrally formed with the second hinge plate 32 or a separate component coupled with the second hinge plate 32 for limiting an angle of rotation of the second hinge plate 32 with respect to the first hinge plate 30.

Referring again to FIG. 2, the second hinge assembly 24 can be any suitable hinge assembly that facilitates opening and closing of the door 20, in concert with the first hinge assembly 22, the details of which are not germane to the present disclosure. In one example, the second hinge assembly 24 can include a conventional hinge assembly that includes a pivot pin extending between an upper portion of the door 20 and an adjacent portion of the of the cabinet 12. In another example, the second hinge assembly 24 can include a hinge assembly as described in Applicant's co-pending U.S. patent application Ser. No. 16/456,544, filed on Jun. 28, 2019, now U.S. Pat. No. 11,326,784, entitled "Mounting Assembly for a Door of a Home Appliance and Method of Use," the contents of which are incorporated herein by reference in their entirety. The first and second hinge assemblies 22 and 24 can be aligned vertically to allow for movement of the door 20 between the closed and open positions shown in FIGS. 1-2.

Figure 6:
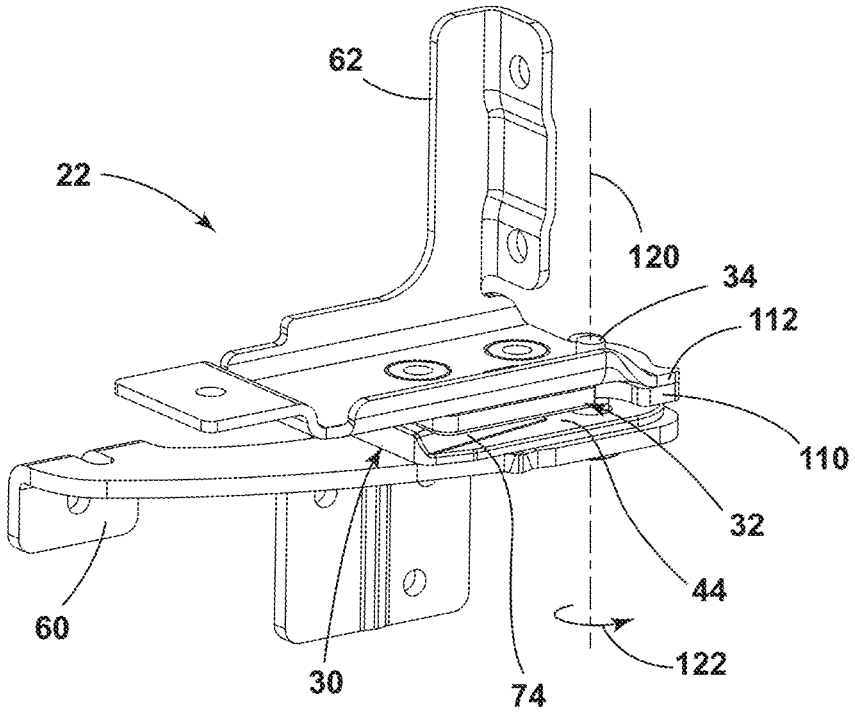
FIG. 6 is a perspective view of a hinge assembly according to aspects of the present disclosure in a closed position.
Figure 7:
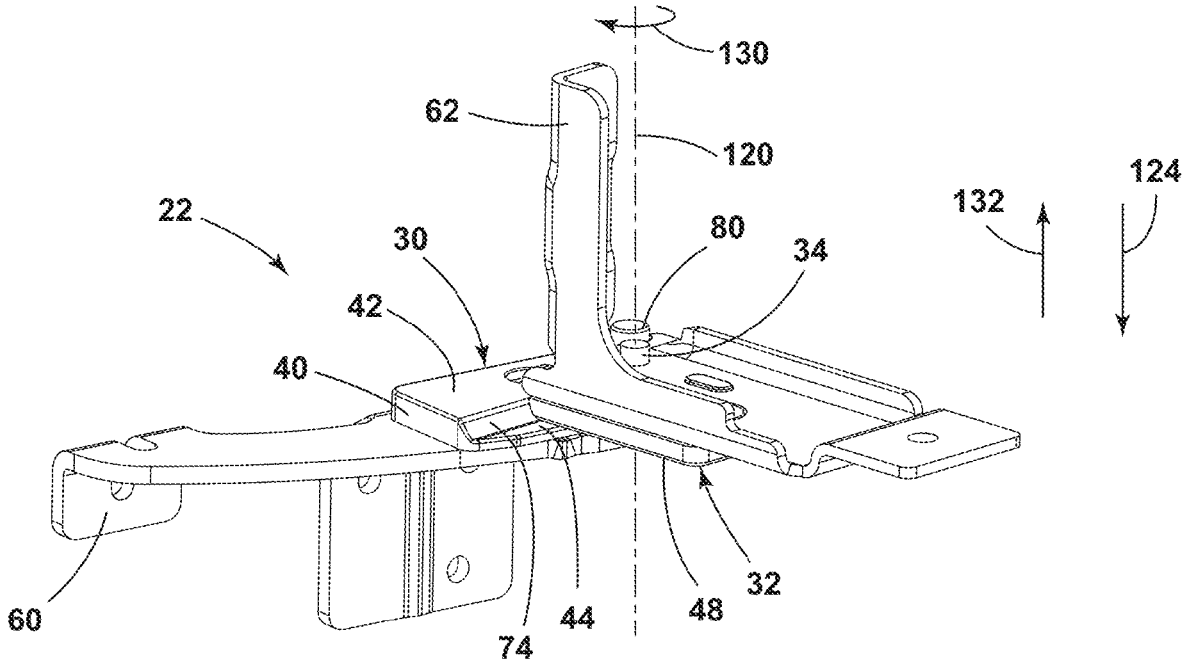
FIG. 7 is a perspective view of the hinge assembly of FIG. 6 in an open position, according to aspects of the present disclosure.
Figure 8:
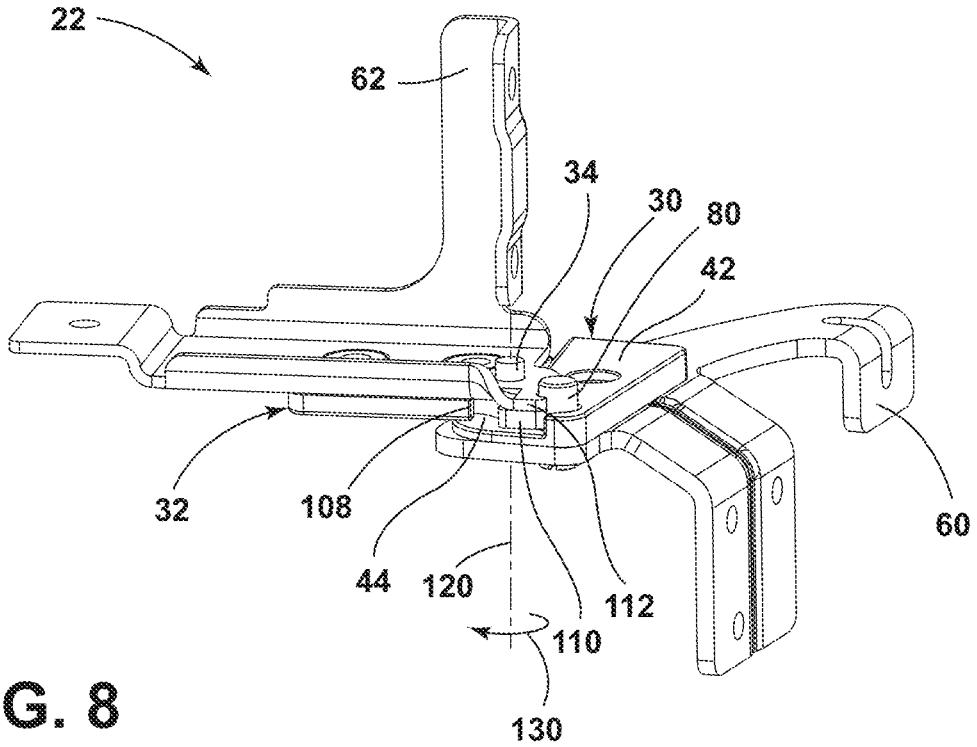
FIG. 8 is a perspective view of the hinge assembly of FIG. 6 in an open position, according to aspects of the present disclosure.

The manner in which the hinge assembly 22 operates during the opening and closing of the door 20 will now be described with particular reference to FIGS. 6-8. Only the hinge assembly 22 is illustrated in FIGS. 6-8 to facilitate viewing the components of the hinge assembly 22, however, it is understood that when the hinge assembly 22, the second hinge plate 32, and the second mounting bracket 62 are described as being in an open position (FIGS. 7-8), this corresponds to the door 20 being in the open position (FIG. 2) by virtue of the second hinge plate 32 and the second mounting bracket 62 being coupled with the door 20. Likewise, when the hinge assembly 22, the second hinge plate 32, and the second mounting bracket 62 are described as being in a closed position (FIG. 6), this corresponds to the door 20 being in the closed position (FIG. 1).

With reference to FIG. 6, when the hinge assembly 22 is in the closed position, the first hinge plate 30 and the second hinge plate 32 are aligned such that the second surface 48 of the second hinge plate 32 engages the first surface 42 of the first hinge plate 30. As the hinge assembly 22 is moved into the open position (to open the door 20), the second hinge plate 32, the second mounting bracket 62, and the third hinge plate 102 are rotated about the vertical axis 120 defined by the pivot pin 34, as illustrated by arrow 122, into the position illustrated in FIGS. 7-8.

As illustrated in FIGS. 7-8, as the second hinge plate 32 is rotated about the axis 120, the second hinge plate 32 is moved off the step 40 and the second surface 48 disengages the first surface 42. As the second surface 48 disengages the first surface 42, the second hinge plate 32 travels down the step 40, as indicated by arrow 124, and the second hinge plate 32 and the second mounting bracket 62 (and the mounted door 20) move vertically along the pivot pin 34 into a vertically offset position relative to the closed position. In the open position, the second surface 48 of the second hinge plate 32 engages the body 44 of the first hinge plate 30. As illustrated in FIG. 8, the first stop 80 engages the projection 110 and the second stop 112 to limit an angle of rotation of the second hinge plate 32 about the vertical axis 120, thereby limiting the opening angle or the angle of rotation of the door 20 relative to the cabinet 12.

To move the hinge assembly 22, and thus the door 20, back into the closed position of FIG. 6, the second hinge plate 32 is rotated about the vertical axis 120 in the direction indicated by arrow 130 (FIGS. 7-8). The step 40 inhibits movement of the second hinge plate 32 back into the closed position of FIG. 6 by virtue of an edge of the second hinge plate 32 engaging the wall 74 of the step 40. In order to move the second hinge plate 32 back into the closed position of FIG. 6, a user must apply a vertical force in the direction of arrow 132, to lift the second hinge plate 32 back up the step 40 as the user rotates the door 20 in the direction of arrow 130 to bring the second surface 48 back into engagement with the first surface 42 in the closed position. In this manner, the door 20 is inhibited from inadvertently moving back into the closed position while a user is accessing the cooking chamber 16. The hinge assembly 22 is configured such that the second hinge plate 32, and thus the door 20, travel downward, with gravity, during the opening of the door 20 and thus the hinge assembly 22 does not require any additional vertical force on the part of the user in order to open the door 20; the user is only required to impart an additional vertical force in order to move the door 20 back into the closed position.

The dimensions of the step 40 and the second hinge plate 32 can be configured such that the second hinge plate 32 travels downward off the step 40 when the second hinge plate 32 is rotated about the vertical axis 120 to a predetermined angle of rotation. In this manner, the door 20 can be inhibited from inadvertently closing when the door 20 has been opened to a predetermined angle of rotation relative to the cabinet 12. The predetermined angle of rotation can correspond to any suitable angle, such as for example, a maximum opening angle of the door 20. For example, the first stop 80 and the second stop 112 can be configured to limit the angle of rotation of the second hinge plate 32 about the pivot pin 34 relative to the first hinge plate 30 to a maximum angle of rotation that limits the opening angle of the door 20 to a maximum opening angle. The dimensions of the step 40 and the second hinge plate 32 can be configured such that the second hinge plate 32 travels downward off the step 40 when the angle of rotation of the second hinge plate 32 about the pivot pin 34 relative to the first hinge plate 30 satisfies the maximum angle of rotation.

When the first hinge plate 30 is coupled with the cabinet 12 and the second hinge plate 32 is coupled with the door 20, as illustrated in FIGS. 1-8, when the hinge assembly 22 is moved into the open position, the second hinge plate 32 travels off the step 40 and the first and second surfaces 42 and 48 become disengaged, as described above. The hinge assembly 22 can operate in a similar manner when the locations of the first and second hinge plates 30 and 32 are reversed. When the first hinge plate 30 is coupled with door 20 and the second hinge plate 32 is coupled with the cabinet 12, when the door 20 is moved into the open position, the step 40 (carried by the first hinge plate 30) travels off the second surface 48 of the second hinge plate 32 to disengage the first and second surfaces 42 and 48. In this configuration, the step 40 still inhibits the door 20 from inadvertently closing. To close the door 20, a vertical force is required to lift the step 40 upward relative to the second hinge plate 32 to bring the first and second surfaces 42 and 48 back into engagement in the closed position.

The dimensions of the step 40 and the second hinge plate 32 can be configured such that a predetermined amount of vertical force is required to overcome the step 40 and move the second hinge plate 32 (and the door 20) back into the closed position. As discussed above, the vertical offset of the step 40 and the angle of the wall 74 between the first surface 42 and the body 44 of the first hinge plate 30 can be selected to require a predetermined amount of vertical force to be imparted by a user of the cooking oven 10 in order to lift the second hinge plate 32 back up the step 40 and close the door 20. Optionally, the second hinge plate 32 can include a ramped or angled edge that engages the wall 74 to facilitate movement of the second hinge plate 32 along the wall 74 as the second hinge plate 32 is moved back into the closed position. The first hinge plate 30, the second hinge plate 32, the third hinge plate 102, and/or the pivot pin 34 can optionally include additional materials or coatings to facilitate operation of the hinge assembly 22 and/or to protect the components of the hinge assembly 22 from wear. For example, the first surface 42 and the wall 74 can include an anti-friction material to facilitate movement of the second hinge plate 32 down and up the step 40 during opening and closing of the door 20.

Additional aspects of the present disclosure may include:

According to a first aspect of the present disclosure, a home appliance, includes: a cabinet defining an interior and having an access opening to a chamber disposed within the interior; a door coupled with the cabinet to selectively provide access to the chamber; and a hinge assembly for coupling the door with the cabinet for movement between open and closed positions about a vertical axis, wherein the hinge assembly includes: a first hinge plate coupled with the cabinet; and a second hinge plate coupled with the door and moveable relative to the first hinge plate about a pivot pin extending between the first and second hinge plates, wherein one of the first hinge plate and the second hinge plate includes a step having a first surface vertically offset from a body of the hinge plate and the other of the first and second hinge plate includes a second surface that engages the first surface when the door is in the closed position, wherein the hinge assembly is configured such that when the door is moved into the open position, the second hinge plate travels downward relative to the first hinge plate such that the first surface becomes disengaged from the second surface, and wherein the step is configured to inhibit movement of the door back to the closed position until a vertical force is applied to lift the second hinge plate relative to the first hinge plate to bring the first and second surfaces into engagement.

According to a second aspect of the present disclosure, the home appliance according to the first aspect, wherein the hinge assembly further includes: a stop that limits an angle of rotation of the second hinge plate about the pivot pin relative to the first hinge plate to a maximum angle of rotation.

According to a third aspect of the present disclosure, the home appliance according to the second aspect, wherein the step is configured such that the second hinge plate travels downward relative to the first hinge plate when the angle of rotation of the second hinge plate satisfies the maximum angle of rotation.

According to a fourth aspect of the present disclosure, the home appliance according to any one of the first to the third aspects, wherein the first hinge plate is coupled with the cabinet by a first mounting bracket and the second hinge plate is coupled with the door by a second mounting bracket.

According to a fifth aspect of the present disclosure, the home appliance according to the fourth aspect, further including: a first stop provided on at least one of the first hinge plate and the first mounting bracket; a second stop provided on at least one of the second hinge plate and the second mounting bracket, and wherein the first stop engages the second stop when the door is moved into the open position to limit an angle of rotation of the door relative to the cabinet.

According to a sixth aspect of the present disclosure, the home appliance according to any one of the first to the fifth aspects, wherein the step is coupled with the body by a wall extending at an angle of about 90 degrees or less relative to a horizontal plane through the body.

According to a seventh aspect of the present disclosure, the home appliance according to any one of the first to the sixth aspects, wherein the step is vertically offset from the body by from about 2.5 mm to about 3.5 mm.

According to an eighth aspect of the present disclosure, the home appliance according to the seventh aspect, wherein the step is coupled with the body by a wall extending at an angle of about 50 degrees to about 70 degrees relative to a horizontal plane through the body.

According to a ninth aspect of the present disclosure, a hinge assembly for rotatably coupling a door to a cabinet of a home appliance to selectively move the door between open and closed positions about a vertical axis, the hinge assembly including: a first hinge plate configured to couple with the cabinet; and a second hinge plate configured to couple with the door and moveable relative to the first plate about a pivot pin extending between the first and second hinge plates, wherein one of the first hinge plate and the second hinge plate includes a step having a first surface vertically offset from a body of the hinge plate and the other of the first and second hinge plate includes a second surface that engages the first surface when the hinge assembly is in a closed position, wherein the hinge assembly is configured such that when the hinge assembly is moved into an open position, the second hinge plate travels downward relative to the first hinge plate such that the first surface becomes disengaged from the second surface, and wherein the step is configured to inhibit movement to the closed position until a vertical force is applied to lift the second hinge plate relative to the first hinge plate to bring the first and second surfaces into engagement.

According to a tenth aspect of the present disclosure, the home appliance according to the ninth aspect, wherein the hinge assembly further includes: a stop that limits an angle of rotation of the second hinge plate about the pivot pin relative to the first hinge plate to a maximum angle of rotation.

According to an eleventh aspect of the present disclosure, the home appliance according to the tenth aspect, wherein the step is configured such that the second hinge plate travels downward relative to the first hinge plate when the angle of rotation of the second hinge plate satisfies the maximum angle of rotation.

According to a twelfth aspect of the present disclosure, the home appliance according to any one of the ninth to the eleventh aspects, further including: a first mounting bracket configured to couple the first hinge plate with the cabinet; and a second mounting bracket configured to couple the second hinge plate with the door.

According to a thirteenth aspect of the present disclosure, the home appliance according to the twelfth aspect, further including: a first stop provided on at least one of the first hinge plate and the first mounting bracket; and a second stop provided on at least one of the second hinge plate and the second mounting bracket, and wherein the first stop engages the second stop when the second hinge plate is moved relative to the first hinge plate to limit an angle of rotation of the second hinge plate relative to the first hinge plate.

According to a fourteenth aspect of the present disclosure, the home appliance according to the twelfth aspect, further including: a third hinge plate rotatably mounted on the pivot pin between the first and second hinge plates and configured to be moved by the second hinge plate when the second hinge plate is moved relative to the first hinge plate, and wherein the third hinge plate includes a projection that is configured to engage one of the first and second stops when the second hinge plate is moved relative to the first hinge plate to limit an angle of rotation of the second hinge plate relative to the first hinge plate.

According to a fifteenth aspect of the present disclosure, the home appliance according to any one of the ninth to the fourteenth aspects, wherein the step is coupled with the body of the hinge plate by a wall extending at an angle of about 90 degrees or less relative to a horizontal plane through the body.

According to a sixteenth aspect of the present disclosure, the home appliance according to any one of the ninth to the fifteenth aspects, wherein the step is vertically offset from the body of the hinge plate by from about 2.5 mm to about 3.5 mm.

According to a seventeenth aspect of the present disclosure, the home appliance according to the sixteenth aspect, wherein the step is coupled with the body by a wall extending at an angle of about 50 degrees to about 70 degrees relative to a horizontal plane through the body.

According to an eighteenth aspect of the present disclosure, a method of assembling a home appliance including a cabinet defining an interior and having an access opening to a chamber disposed within the interior, and a door coupled with the cabinet for movement about a vertical axis between open and closed positions, the method including: coupling a first hinge plate of a hinge assembly with the cabinet; coupling a second hinge plate of the hinge assembly to the door; and providing a pivot pin extending between the first and second hinge plates such that the second hinge plate moves relative to the first hinge plate about the pivot pin when the door is moved between the open and closed positions, and wherein one of the first hinge plate and the second hinge plate includes a step having a first surface vertically offset from a body of the hinge plate and the other of the first and second hinge plate includes a second surface that engages the first surface when the door is in the closed position, wherein the hinge assembly is configured such that when the door is moved into the open position, the second hinge plate travels downward relative to the first hinge plate such that the first surface becomes disengaged from the second surface, and wherein the step is configured to inhibit movement of the door to the closed position until a vertical force is applied to lift the second hinge plate relative to the first hinge plate to bring the first and second surfaces into engagement.

According to a nineteenth aspect of the present disclosure, the home appliance according to the eighteenth aspect, wherein the step is configured such that the second hinge plate travels downward relative to the first hinge plate when the door is opened to a predetermined angle of rotation.

According to a twentieth aspect of the present disclosure, the home appliance according to the nineteenth aspect, wherein the hinge assembly further includes: a stop that limits an angle of rotation of the second hinge plate relative to the first hinge plate.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A hinge assembly for coupling a door with a cabinet for movement between open and closed positions about a vertical axis, wherein said hinge assembly comprises:

a first hinge plate configured to be coupled with said cabinet;

a second hinge plate configured to be coupled with said door and moveable relative to the first hinge plate about a pivot pin extending between the first and second hinge plates, wherein one of the first hinge plate and the second hinge plate comprises a step including a linear wall portion and an arcuate socket portion and that together extend across a width of the first hinge plate, the step having a first surface vertically offset from a body of one of the first hinge plate and the second hinge plate and the other of the first hinge plate and the second hinge plate comprises a second surface that engages the first surface when said door is in the closed position, and wherein said hinge assembly is configured such that when said door is moved into the open position, the second hinge plate travels downward relative to the first hinge plate such that the first surface becomes disengaged from the second surface; and a third hinge plate disposed between the first hinge plate and the second hinge plate, the third hinge plate including a projection extending from the third hinge plate in a direction co-planar with a planar extent of the third hinge plate.

2. The hinge assembly of claim 1, further comprising:

a stop that limits an angle of rotation of the second hinge plate about the pivot pin relative to the first hinge plate to a maximum angle of rotation.

3. The hinge assembly of claim 2, wherein the step is configured such that the second hinge plate travels downward relative to the first hinge plate when the angle of rotation of the second hinge plate satisfies the maximum angle of rotation.

4. The hinge assembly of claim 1, wherein the first hinge plate is coupled with the cabinet by a first mounting bracket and the second hinge plate is coupled with the door by a second mounting bracket.

5. The hinge assembly of claim 4, further comprising:

a first stop provided on at least one of the first hinge plate and the first mounting bracket; and a second stop provided on at least one of the second hinge plate and the second mounting bracket.

6. The hinge assembly of claim 5, wherein the first stop engages the second stop when the door is moved into the open position to limit an angle of rotation of the door relative to the cabinet.

7. The hinge assembly of claim 1, wherein the step is coupled with the body by a wall extending at an angle of 90 degrees or less relative to a horizontal plane through the body.

8. The hinge assembly of claim 1, wherein the step is coupled with the body by a wall extending at an angle of between 50 degrees and 70 degrees relative to a horizontal plane through the body.

9. The hinge assembly of claim 4, wherein the first mounting bracket includes an aperture that receives a sleeve of the first hinge plate that receives and supports the pivot pin therein.

10. A hinge assembly, comprising:

a first hinge plate;

a second hinge plate moveable relative to the first hinge plate about a pivot pin, wherein one of the first hinge plate and the second hinge plate comprises a step including a linear wall portion and a curved socket portion and having a first surface vertically offset from a body of one of the first hinge plate and the second hinge plate and the other of the first and second hinge plate comprises a second surface that engages the first surface when said hinge assembly is in a closed position; and a third hinge plate including a non-circular periphery and a projection extending from the non-circular periphery, wherein the second hinge plate travels downward relative to the first hinge plate during opening such that the first surface becomes disengaged from the second surface, and wherein the step is configured to inhibit movement to the closed position until a vertical force is applied to lift the second hinge plate relative to the first hinge plate to bring the first and second surfaces into engagement.

11. The hinge assembly of claim 10, further comprising:

a stop that limits an angle of rotation of the second hinge plate about the pivot pin relative to the first hinge plate to a maximum angle of rotation.

12. The hinge assembly of claim 11, wherein the step is configured such that the second hinge plate travels downward relative to the first hinge plate when the angle of rotation of the second hinge plate satisfies the maximum angle of rotation.

13. The hinge assembly of claim 10, further comprising:

a first mounting bracket configured to couple the first hinge plate with a cabinet; and a second mounting bracket configured to couple the second hinge plate with a door.

14. The hinge assembly of claim 10, wherein the third hinge plate is rotatably mounted on the pivot pin between the first and second hinge plates and configured to be moved by the second hinge plate when the second hinge plate is moved relative to the first hinge plate.

15. The hinge assembly of claim 14, wherein the second hinge plate includes a leg that engages the projection of the third hinge plate.

16. The hinge assembly of claim 10, wherein the step is coupled with the body of one of the first hinge plate and the second hinge plate by a wall extending at an angle of 90 degrees or less relative to a horizontal plane through the body.

17. The hinge assembly of claim 10, wherein the step is vertically offset from the body of one of the first hinge plate and the second hinge plate by 2.5 mm to 3.5 mm.

18. The hinge assembly of claim 17, wherein the step is coupled with the body by a wall extending at an angle of between 50 degrees and 70 degrees relative to a horizontal plane through the body.

* * * * *